US010140902B2

(12) United States Patent
Shi et al.

(10) Patent No.: US 10,140,902 B2
(45) Date of Patent: Nov. 27, 2018

(54) DISPLAY METHOD AND DISPLAY PANEL

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Lingyun Shi, Beijing (CN); Xue Dong, Beijing (CN); Hyungkyu Kim, Beijing (CN); Haiwei Sun, Beijing (CN); Hao Zhang, Beijing (CN); Quanhua He, Beijing (CN); Kai Yang, Beijing (CN)

(73) Assignees: BOE Technology Group Co., Ltd., Beijing (CN); Beijing BOE Optoelectronics Technology Co., Ltd., Beijing (CN)

( * ) Notice: Subject to any disclaimer, the term of this patent is extended or adjusted under 35 U.S.C. 154(b) by 99 days.

(21) Appl. No.: 14/647,555

(22) PCT Filed: Sep. 29, 2014

(86) PCT No.: PCT/CN2014/087794
§ 371 (c)(1),
(2) Date: May 27, 2015

(87) PCT Pub. No.: WO2015/143858
PCT Pub. Date: Oct. 1, 2015

(65) Prior Publication Data

US 2016/0049110 A1 Feb. 18, 2016

(30) Foreign Application Priority Data

Mar. 25, 2014 (CN) ..... 2014 1 0114260

(51) Int. Cl.
*G09G 3/36* (2006.01)
*G09G 3/3208* (2016.01)
*G09G 3/20* (2006.01)

(52) U.S. Cl.
CPC ..... *G09G 3/2003* (2013.01); *G09G 3/20* (2013.01); *G09G 3/2074* (2013.01);
(Continued)

(58) Field of Classification Search
CPC ..... G09G 2300/0452; G09G 3/2003; G09G 3/3607
See application file for complete search history.

(56) References Cited

U.S. PATENT DOCUMENTS 6,088,062 A 7/2000 Kanou et al.
2002/0154152 A1 10/2002 Tezuka et al.
(Continued)

FOREIGN PATENT DOCUMENTS

CN 101123079 A 2/2008
CN 102209984 A 10/2011
(Continued)

OTHER PUBLICATIONS

1st office action issued in Chinese application No. 201410114260.1 dated Aug. 4, 2015.
(Continued)

*Primary Examiner* — Nan-Ying Yang
(74) *Attorney, Agent, or Firm* — Nath, Goldberg & Meyer; Joshua B. Goldberg

(57) ABSTRACT

The present invention provides a display method and a display panel. The display panel comprises a plurality of rows of sub-pixels, the adjacent sub-pixels in the column direction having different colors and being staggered from each other by ½ of the sub-pixel in the row direction. The display method comprises: S1, generating an original image
(Continued)

composed of a matrix of virtual pixels; S2, enabling the virtual pixels to correspond to sampling locations, wherein each sampling location corresponds to a virtual pixel; each sampling location is located between every two adjacent rows of the sub-pixels, and corresponds to a location between two sub-pixels in one row and a central location of a sub-pixel in the other row; and S3, calculating a display component of each sub-pixel in accordance with original components of corresponding colors of virtual pixels corresponding to the sub-pixel. The present invention is suitable for high resolution display.

16 Claims, 2 Drawing Sheets

(52) U.S. Cl.
CPC ... *G09G 3/3208* (2013.01); *G09G 2300/0426* (2013.01); *G09G 2300/0452* (2013.01); *G09G 2310/0232* (2013.01); *G09G 2340/0457* (2013.01)

(56) References Cited

U.S. PATENT DOCUMENTS

2005/0007327 A1* 1/2005 Elion ..... G09G 3/3607 345/88
2005/0151752 A1* 7/2005 Phan ..... G09G 3/2003 345/589
2005/0259114 A1 11/2005 Belmon et al.
2008/0025625 A1* 1/2008 Ishizaka ..... G06T 3/4007 382/248
2008/0030527 A1* 2/2008 Namie ..... G06T 3/4023 345/698
2009/0128467 A1* 5/2009 Chen ..... G09G 3/3607 345/87
2011/0140999 A1* 6/2011 Beland ..... G06F 3/1446 345/82
2011/0206297 A1* 8/2011 Tsuda ..... G09G 5/026 382/300
2012/0293531 A1* 11/2012 Wang ..... G09G 3/2003 345/589
2013/0215360 A1 8/2013 Pollack et al.
2014/0307430 A1* 10/2014 Lo ..... G09F 13/00 362/231

FOREIGN PATENT DOCUMENTS

CN 102622981 A 8/2012
CN 103151018 A 6/2013
CN 103886808 A 6/2014
CN 103886809 A 6/2014
CN 103886825 A 6/2014
CN 103903524 A 7/2014
CN 103903549 A 7/2014
CN 103915044 A 7/2014
CN 103927946 A 7/2014
EP 2 333 760 A2 6/2011
JP 2000-122030 A 4/2000
JP 2009-282102 A 12/2009
KR 10-1015332 B1 2/2011
TW I315512 B 10/2009
WO 2004/100117 A1 11/2004
WO 2012/077564 A1 6/2012

OTHER PUBLICATIONS

Form PCT/IB/310 issued in international application No. PCT/CN2014/087794 dated Sep. 29, 2014.
Extended European Search Report dated dated Oct. 2, 2017 corresponding application No. 14863056.9-1903.
Extended European Search Report dated Jul. 8, 2016 in corresponding European Patent Application No. 14861143.7.

* cited by examiner

-- PRIOR ART --

DISPLAY METHOD AND DISPLAY PANEL

This is a National Phase Application filed under 35 U.S.C. 371 as a national stage of PCT/CN2014/087794 filed on Sep. 29, 2014, an application claiming the benefit to Chinese application No. 201410114260.1 filed on Mar. 25, 2014; the content of each of which is hereby incorporated by reference in its entirety.

FIELD OF THE INVENTION

The present invention relates to the field of display technology, and particularly to a display method and a display panel.

BACKGROUND OF THE INVENTION

As illustrated in FIG. 1, a traditional display panel includes a plurality of 'pixels 1' arranged in a matrix, in which each pixel 1 is composed of three adjacent red, green and blue sub-pixels 9 which are arranged in a row. Each sub-pixel 9 can independently emit light of certain luminance (of course the light has specific color), and by light mixing effect the three sub-pixels 9 together constitute an independent display 'point' on a screen.

With the development of technology, the resolution of a display panel becomes increasingly higher, which requires reducing the dimension of the pixel (or the sub-pixel) in the display panel. However, due to limitation of processes, the dimension of the sub-pixel cannot be infinitely reduced, which becomes a bottleneck restricting further improvement in resolution. In order to solve the problem mentioned above, a virtual algorithm technology may be employed to improve the resolution 'sensed' by the user by 'sharing' the sub-pixels; that is to say, one sub-pixel can be used for displaying contents in a plurality of pixels, thereby enabling the visual resolution to be higher than the actual physical resolution.

However, the effect of the existing virtual algorithm technologies is not good enough, some will cause defects such as image distortion, jagged lines, grid spots and the like and some will require calculations such as picture partitioning, picture layering and area ratio, resulting in complex process and large calculation amount.

SUMMARY OF THE INVENTION

In view of the problem that the effect of the existing high resolution display technology is not good enough, the object of the present invention is to provide a display method and a display panel, which can realize high resolution display and provide good display effect.

A technical solution employed to solve the technical problem of the present invention is a display method applied to a display panel, wherein the display panel includes a plurality of rows of sub-pixels, the sub-pixels in each row are formed by cyclically arranging sub-pixels of three colors, the cyclical orders of the sub-pixels in the respective rows are the same, and the adjacent sub-pixels in the column direction have different colors and are staggered from each other by ½ of the sub-pixel in the row direction. The display method comprises the following steps:

S1, generating an original image composed of a matrix of virtual pixels;

S2, enabling the virtual pixels to correspond to sampling locations, wherein each sampling location corresponds to a virtual pixel; wherein each sampling location is located between every two adjacent rows of the sub-pixels, and corresponds to a location between two sub-pixels in one row and a central location of a sub-pixel in the other row; and S3, calculating a display component of each sub-pixel in accordance with original components of corresponding colors of the virtual pixels corresponding to the sub-pixel.

The terms 'row' and the 'column' used herein refer to two directions perpendicular to each other in the matrix of virtual pixels (or sub-pixels), which are irrelevant to the shape of the sub-pixels, placement of the display panel, layout of leads and the like.

Optionally, the display panel is a liquid crystal display panel or an organic light-emitting diode (OLED) display panel.

Optionally, the sub-pixels of three colors are a red sub-pixel, a blue sub-pixel and a green sub-pixel.

Optionally, the dimension of a sub-pixel in the first or the last row in the column direction is ½ of that of a standard sub-pixel in the column direction. The standard sub-pixel refers to a sub-pixel which is not located on the edge of the display panel.

Optionally, the step S3 includes: obtaining a display component of each sub-pixel by multiplying the original components of the corresponding colors of the virtual pixels corresponding to the sub-pixel by respective proportional coefficients and then summarizing the respective products.

Further optionally, the sum of the proportional coefficients for the original components of the corresponding colors of the respective virtual pixels corresponding to each sub-pixel is 1.

Further optionally, the proportional coefficient for the original component of the corresponding color of the virtual pixel corresponding to the standard sub-pixel ranges from 0 to 0.3.

Further optionally, the proportional coefficient ranges from 0.1 to 0.2.

Further optionally, the step S3 comprises: the display component of a sub-pixel is equal to a median value of the original component of the corresponding color of the respective virtual pixels corresponding to the sub-pixel.

Optionally, both the original component and the display component are luminance, and the method further includes a step S4 after the step S3: calculating the gray scale of each sub-pixel in accordance with the display component of the sub-pixel.

The present invention further provides a display panel, comprising a plurality of rows of sub-pixels, in which the sub-pixels in each row are formed by cyclically arranging sub-pixels of three colors, and the cyclical orders of the sub-pixels in the respective rows are the same, the adjacent sub-pixels in the column direction have different colors and are staggered from each other by ½ of the sub-pixel in the row direction.

In the display method of the present invention, the content displayed by each sub-pixel (i.e. standard sub-pixel) is substantially determined by six virtual pixels adjacent to this sub-pixel. That is, one sub-pixel is 'shared' by six virtual pixels; or rather, each sub-pixel is used for representing the contents of the six virtual pixels at the same time, thereby enabling the visual resolution to be six times of the actual physical resolution in combination with a specific display panel and achieving a better display effect. At the same time, the content displayed by each sub-pixel is directly obtained by calculation based on a plurality of specific virtual pixels without complex calculations such as 'partitioning, layering and area ratio'. Therefore, the display method has simple process and small calculation amount.

The present invention is especially suitable for high resolution display.

REFERENCE NUMERALS

1: Pixel
2: Virtual pixel
8: Sampling location
9: Sub-pixel

DETAILED DESCRIPTION OF THE EMBODIMENTS

The present invention will be further described below in conjunction with the accompanying drawings and embodiments, in order to make a person skilled in the art better understand the technical solution of the present invention

Embodiment 1

Figure 1:
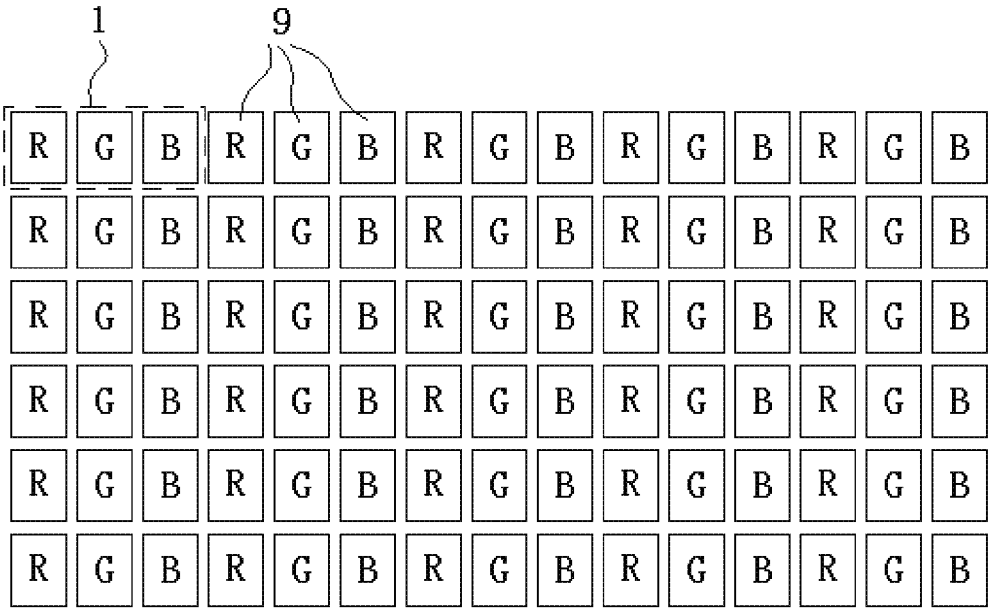
FIG. 1 is a structural diagram of an existing display panel.
Figure 2:
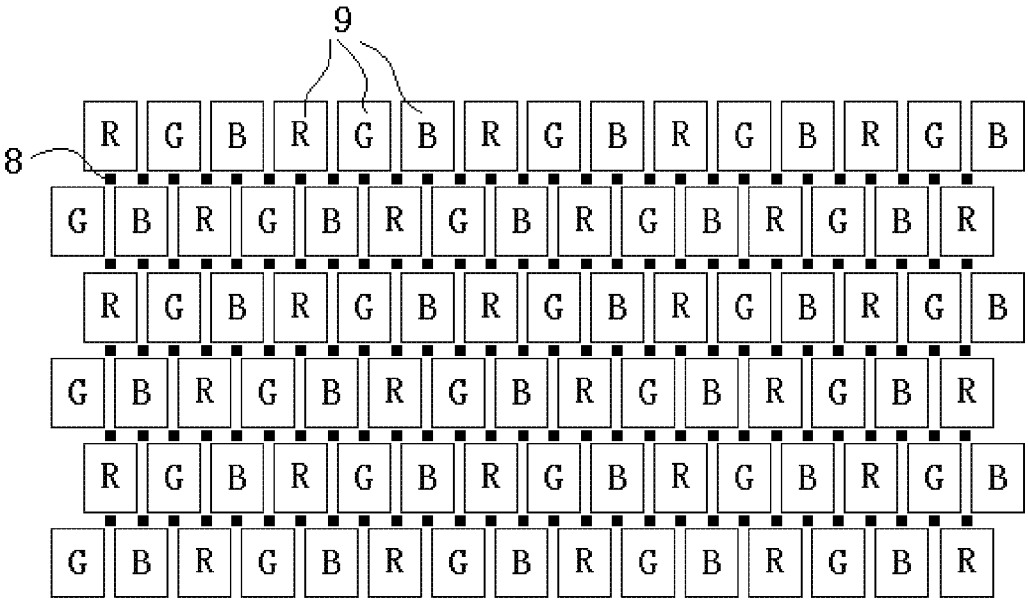
FIG. 2 is a structural diagram of a display panel using a display method of embodiment 1 of the present invention.
Figure 3:
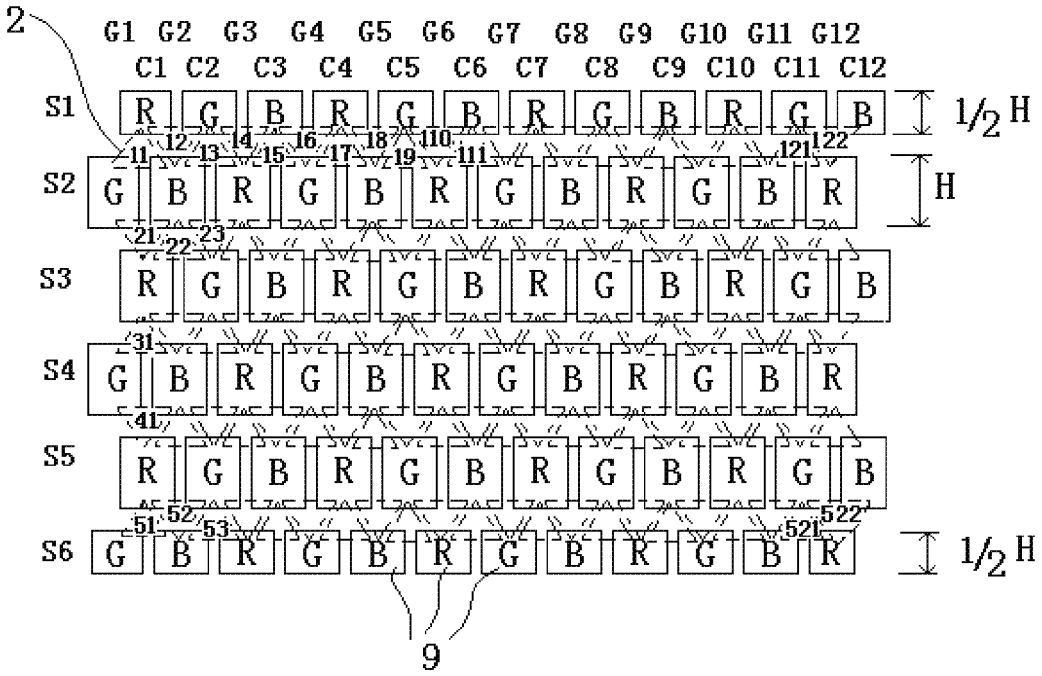
FIG. 3 is a schematic diagram illustrating locations corresponding to virtual pixels in the display method of embodiment 1 of the present invention.

As illustrated in FIG. 2 and FIG. 3, the embodiment provides a display method, which is suitable for a display panel of the embodiment.

The display panel of the embodiment includes a plurality of rows of sub-pixels 9, in which the sub-pixels 9 in each row are formed by cyclically arranging sub-pixels 9 of three colors in turn, and cyclical orders of the sub-pixels 9 in the respective rows are the same. Optionally, the sub-pixels 9 of three colors are red sub-pixels 9, blue sub-pixels 9 and green sub-pixels 9, respectively, and the embodiment will be described by taking this mode as an example, i.e. the display panel of the embodiment is in an RGB mode. Certainly, the display panels in other arrangement modes, such as arrangement including other colors or arrangement in which the number of the sub-pixels in each pixel is 2, 4 or other number, also can adopt display methods similar to the present invention.

That is, as illustrated in FIG. 2, the sub-pixels 9 of three different colors in each row form a cyclical unit (for example, a cyclical unit of 'red sub-pixel 9 to green sub-pixel 9 to blue sub-pixel 9'), and a plurality of cyclical units constitute a row of the sub-pixels 9; in different rows, starting sub-pixels 9 have different colors, but the cyclical arrangement orders of the sub-pixels 9 are the same. For example, in FIG. 2, the first sub-pixel in the first row is a red sub-pixel 9, and the sub-pixels in the first row are cyclically arranged according to an order of 'red sub-pixel 9 to green sub-pixel 9 to blue sub-pixel 9 to red sub-pixel 9'; the first sub-pixel in the second row is a green sub-pixel 9, and the sub-pixels in the second row are cyclically arranged according to an order of 'green sub-pixel 9 to blue sub-pixel 9 to red sub-pixel 9 to green sub-pixel 9'. It can be seen that, the cyclical orders of the sub-pixels 9 in the two rows are actually the same.

Meanwhile, the adjacent sub-pixels 9 in the column direction are staggered from each other by ½ of the sub-pixel in the row direction, and the sub-pixels 9 of the same color are not located in the same column.

That is, the adjacent rows in the display panel of the embodiment are not 'aligned' in the column direction, but are ½ of the sub-pixel 9 'staggered' from each other. Therefore, in the column direction, except the few sub-pixels 9 on the edges, each sub-pixel 9 is adjacent to two sub-pixels 9 in an adjacent row on each side, and moreover, the sub-pixel 9 has a color different from those of the two sub-pixels 9, since the sub-pixels 9 of the same color are not located in the same column. In this way, any three adjacent sub-pixels 9 of different colors will constitute a '品' arrangement which enables the sub-pixels 9 of three colors to be distributed more uniformly and the display quality to be better.

Optionally, the display panel of the embodiment is an organic light-emitting diode (OLED) panel, that is to say, each sub-pixel 9 thereof includes a light-emitting unit (organic light-emitting diode), and the light-emitting unit of each sub-pixel 9 directly emits light of required color and luminance. Or, the display panel can also be a liquid crystal display panel, that is to say, each sub-pixel 9 thereof includes a filter unit, and the light becomes the light of required color and luminance after transmitting the filter unit of each sub-pixel 9.

In summary, the display panel may be of various types, so long as distribution of the sub-pixels 9 thereof accords with the conditions above, which will not be described in detail herein.

Specifically, the display method of the embodiment includes the following steps.

S101. An original image composed of a matrix of virtual pixels 2 is generated according to image information.

That is, the image information (i.e. content of image to be displayed) from a graphics card and the like is processed to generate an original image composed of a matrix of a plurality of 'points (i.e. virtual pixels 2)'; each virtual pixel 2 includes original components of red, green and blue colors, in order to represent the respective 'densities' of red, green and blue colors on the 'point'.

In this case, the component in the above 'original component', subsequent 'display component' or the like refers to 'density' of the color which should be displayed in the corresponding location and can be represented by 'luminance', and the embodiment takes it as an example. Certainly, so long as each 'component' can represent the 'density' to be displayed, other metric parameters can also be adopted. For example, 'gray scale', 'saturation' or the like can be used as unit of the 'component'.

S102. Each virtual pixel 2 is caused to correspond to a sampling location 8; wherein each sampling location 8 is located between every two adjacent rows of the sub-pixels 9, and corresponds to a location between two sub-pixels 9 in one row and a central location of a sub-pixel 9 in the other row That is, as illustrated in FIG. 2, a plurality of 'sampling locations 8' will be formed on the display panel in accordance with the above arrangement mode. Specifically, each sampling location 8 is located between the two adjacent rows of the sub-pixels 9, and any sampling location 8 is located between two adjacent sub-pixels 9 in one adjacent row and also located in the middle of a sub-pixel 9 in the other adjacent row. Or rather, a central location of every three sub-pixels 9 which constitute a '品' arrangement is a sampling location 8. It can be seen that, the sampling locations 8 also constitute a 'matrix' of which row number is 1 less than that of the sub-pixels 9 and column number is 2 less than twice of the number (because the sub-pixels 9 in different rows are not aligned to each other in the column direction, it is not called a column number) of the sub-pixels 9 in one row. Certainly, it should be understood that each sampling location 8 is not an entity which really exists but is only used for representing a corresponding location, and all the sampling locations 8 constitute a matrix for locating the locations of the virtual pixels.

The step is as illustrated in FIG. 3, each virtual pixel 2 in the virtual image is caused to correspond to each sampling location 8 mentioned above, in order to determine display components of the sub-pixels 9 in the subsequent process.

For clarity, in FIG. 3, no sampling location 8 is marked anymore but only virtual pixels 2 are marked, in which each virtual pixel 2 is represented by a triangle, and the number mn in the triangle represents the virtual pixel 2 in the $m^{th}$ row and the $n^{th}$ column.

As illustrated in FIG. 3, each virtual pixel 2 corresponds to a sampling location 8, thus forming a "one-on-one" corresponding relationship among the virtual pixels 2 and the sampling locations 8, thereby the complete matrix composed by the triangles in the figure is formed.

It can be seen that, a virtual image of 1920 columns×1080 rows requires 1920×1080) sub-pixels 9 in total. Accordingly, 1081 rows each having 961 (961×2−2=1920) sub-pixels 9 are required. According to the existing display method, (3×1920×1080) sub-pixels 9 are required to display a 1920×1080 image; while according to the display method of the embodiment, the required amount of sub-pixels 9 for displaying an image with the same resolution is (961×1080), which is approximately equal to sixth of the number of the sub-pixels 9 required in the existing display method. Therefore, the display method of the embodiment can increase the display resolution by about six times under the condition of constant physical resolution.

It can be seen that, after each virtual pixel 2 corresponds to the sampling location 8 in accordance with the above corresponding relationship, each virtual pixel 2 necessarily corresponds to three sub-pixels 9 (i.e. the sub-pixels 9 to which three vertexes of the triangle for representing the virtual pixel 2 in FIG. 3 point) around the corresponding sampling location 8. Correspondingly, each sub-pixel 9 necessarily corresponds to one or more virtual pixels 2 (i.e. the vertexes of one or more triangles for representing the virtual pixels 2 point to the sub-pixel 9).

Optionally, as illustrated in FIG. 3, the dimension of the sub-pixel 9 in the first or the last row in the column direction is ½ of that of the standard sub-pixel 9 in the column direction. The standard sub-pixel herein is the sub-pixel which is not located on the edge of the display panel; in other words, the standard sub-pixel is a sub-pixel except the sub-pixels in the first and the last rows of the display panel and that at two ends of each row.

As such, each standard sub-pixel 9 in the middle of the display panel corresponds to 6 virtual pixels 2, while most of the sub-pixels 9 (except the sub-pixels 9 at the two ends) in the first and last rows correspond to only 3 virtual pixels 2, which is a half of the number of the virtual pixels 2 corresponding to a standard sub-pixel 9. Therefore, in order to guarantee a balanced final display effect, the area of the sub-pixel 9 in the first or the last rows should be half of that of the standard sub-pixel 9, and the height of the sub-pixel 9 in the first or the last rows (i.e. the dimension in the column direction) could be set as half of that of the rest sub-pixel 9.

Of course, it can be seen that the sub-pixels 9 at the left or right ends of each row correspond to less virtual pixels 2 than that of a standard sub-pixel 9, thus the dimension of those sub-pixels 9 may be modified. For example, as for a sub-pixel 9 corresponding to 4 virtual pixels 2, its "width" (the dimension in the row direction) may be ⅔ of the width of a standard sub-pixel 9; as for a sub-pixel 9 corresponding to 2 virtual pixels 2, its width may be ⅓ of the width of a standard sub-pixel 9.

S103. The display component of each sub-pixel 9 is calculated in accordance with the original components of the corresponding colors of the virtual pixels 2 corresponding to the sub-pixel 9.

As previously mentioned, each sub-pixel 9 necessarily corresponds to one or more virtual pixels 2, whereby the content (display component) which should be displayed by each sub-pixel 9 can also be obtained by calculating the original components of the corresponding colors of the virtual pixels 2 corresponding to the sub-pixel, and the specific calculation method may be as follows.

The display component of one sub-pixel 9 is obtained by multiplying the original components of the corresponding colors of the virtual pixels 2 corresponding to the sub-pixels 9 by respective proportional coefficients and then summarizing the respective products.

That is, the display component of any one of the sub-pixels 9 is determined by the original components of the corresponding colors of the virtual pixels 2 corresponding to the sub-pixel in accordance with respective proportions.

In this case, the 'proportional coefficient' is preset, which is normally a nonnegative number, preferably a number between 0 and 1. Each virtual pixel 2 corresponding to each sub-pixel 9 has a proportional coefficient (which of course is a proportional coefficient for the corresponding color component thereof), and these proportional coefficients can be the same or different. The proportional coefficients for the virtual pixels corresponding to the different sub-pixels 9 can be the same or different. One virtual pixel 2 corresponds to three sub-pixels 9 of different colors, so the proportional coefficients (or rather the proportional coefficients for the original components of different colors) corresponding to the three sub-pixels 9 can be the same or different.

Optionally, the sum of the proportional coefficients for the original components of the corresponding colors of the virtual pixels 2 corresponding to one sub-pixel 9 is 1.

It can be seen that, the total luminance of the display panel is relevant to the proportional coefficients mentioned above, because each sub-pixel 9 is required to represent the contents of a plurality of the virtual pixels 2 at this time. Moreover, if the sum of the proportional coefficients for the original components of the corresponding colors of the virtual pixels 2 corresponding to one sub-pixel 9 is 1, the constant overall luminance of the display panel and the reality of the display effect can be guaranteed.

Optionally, the proportional coefficient for the original component of the corresponding color of the virtual pixel 2 corresponding to the standard sub-pixel 9 ranges from 0 to 0.3, and more preferably ranges from 0.1 to 0.2.

It can be seen that, each standard sub-pixel 9 corresponds to six virtual pixels 2, so the proportional coefficients thereof are preferably ranges from 0 to 0.3, more preferably ranges from 0.1 to 0.2, so as to ensure that the proportional coefficients are close to each other and their sum is 1. For example, specifically, a display component $B_{S2G2}$ of a blue sub-pixel 9 with a coordinate of S2G2 may be equal to:

$$B_{S2G2}=X\times B_{11}+Y\times B_{12}+Z\times B_{13}+U\times B_{21}+V\times B_{22}+Y\times B_{12}+W\times B_{23};$$

wherein $B_{11}$, $B_{12}$, $B_{13}$, $B_{21}$, $B_{22}$, and $B_{23}$ are blue original components of the virtual pixels 2 with coordinates of (1,1), (1,2), (1,3), (2,1), (2,2) and (2,3) respectively, and X, Y, Z, U, V, W are corresponding proportional coefficients. At this time, the sum of X, Y, Z, U, V, W is preferably 1, each of the coefficients preferably ranges from 0 to 0.3, and more preferably ranges from 0.1 to 0.2, wherein the coordinate of the virtual pixel in the embodiment is represented in a Row-Column mode. For example, a coordinate of (2, 1) represents the second virtual pixel 2 in the second row, i.e. the virtual pixel 2 marked by 21.

Of course, for the sub-pixels 9 other than the standard sub-pixel 9, that is the sub-pixels 9 in the first row and the last row and also at two ends of each row, the calculation formula, proportional coefficients may vary due to the different number of corresponding virtual pixels 2, but the basic calculation manner is the same.

Optionally, as another form of the present embodiment, the display component of a sub-pixel 9 may be equal to a median value of the original component of the corresponding color of the respective virtual pixels 2 corresponding to the sub-pixel 9.

That is, the above display component may be obtained as median value. For example, a blue sub-pixel 9 with a coordinate of S2G2 corresponds to the virtual pixels 2 having a coordinate (1, 1), (1, 2), (1, 3), (2, 1), (2, 2) and (2, 3) respectively, thus the display component $B_{S2G2}$ is equal to the median value of $B_{11}$, $B_{12}$, $B_{13}$, $B_{21}$, $B_{22}$, and $B_{23}$.

The display component may also be calculated using other methods, details thereof is omitted here.

S104. Optionally, when the original components, the display components and the like mentioned above are luminance, the gray scale of each sub-pixel 9 may be calculated in accordance with the display component of the sub-pixel 9.

Specifically, for the display panel of 256 gray scales, the gray scale can be calculated by luminance through the following formula:

$$A=(G/255)^{\gamma}A_{255}$$

wherein A is luminance (i.e. display component) of a certain sub-pixel 9 obtained by calculation; $A_{255}$ is luminance of the sub-pixel having a gray scale value of 255; G, which is an integer between 0 and 255, is a gray scale value corresponding to the luminance A; and γ is a gamma value set at this time.

At this time, all of A, $A_{255}$ and γ are known, so the gray scale G can be correspondingly calculated for subsequent steps.

Certainly, it should be understood that the formula is also changed accordingly, if other modes such as 64 gray scales are adopted at this time. Or rather, the calculation method herein is different, if the original component and the display component adopt other units of measurement.

S105. The sub-pixels 9 are driven by the calculated gray scale values to display. That is, each sub-pixel 9 displays the corresponding gray scale, thus obtaining a corresponding picture. In the display method of the present invention, the content displayed by each sub-pixel (i.e. standard sub-pixel) is substantially determined by six virtual pixels adjacent to this sub-pixel. That is, each sub-pixel is 'shared' by six virtual pixels. Or rather, each sub-pixel is used for representing the contents of the six virtual pixels at the same time, thereby enabling the visual resolution to be six times of the actual resolution in combination with a specific display panel, and a better display effect can be obtained. At the same time, the content displayed by each sub-pixel is directly obtained by calculation according to a plurality of specific virtual pixels without complex calculations such as 'partitioning, layering and area ratio'. Therefore, the display method is simple in process and small in calculating amount.

It may be understood that, the foregoing embodiments are merely exemplary embodiments employed for illustration of the principle of the present invention, and the present invention is not limited thereto. For a person of ordinary skill in the art, various variations and improvements may be made without departing from the spirit and essence of the present invention, and those variations and improvements shall be regarded as falling into the protection scope of the present invention.

The invention claimed is:

1. A display method applied to a display panel, wherein the display panel comprises a plurality of rows of sub-pixels, the sub-pixels in each row are arranged in cyclical orders of sub-pixels of three colors, and the cyclical orders of the sub-pixels in the respective rows being the same; the adjacent sub-pixels in a column direction having different colors and being staggered from each other by ½ of a sub-pixel in a row direction, wherein the display method comprises the following steps:

S1, generating an original image composed of a matrix of virtual pixels;

S2, enabling the virtual pixels to correspond to sampling locations, wherein each sampling location corresponds to a virtual pixel; wherein each sampling location is located between every two adjacent rows of the sub-pixels, and corresponds to a location between two sub-pixels in one row and a central location of a sub-pixel in the other row; and S3, calculating a display component of each sub-pixel in accordance with original components of corresponding colors of the virtual pixels corresponding to the sub-pixel, wherein the virtual pixels are in one-to-one correspondence with the sampling locations, the sampling locations constitute a matrix, the number of rows of the matrix is less than the number of rows of the sub-pixels of the display panel by one and the number of columns of the matrix is less than twice of the number of the sub-pixels in one row by two; and a dimension of a sub-pixel in each of the first row and the last row in the column direction is ½ of that of a standard sub-pixel in the column direction.

2. The display method according to claim 1, wherein the display panel is a liquid crystal display panel or an organic light-emitting diode display panel.

3. The display method according to claim 1, wherein the sub-pixels of three colors are a red sub-pixel, a blue sub-pixel and a green sub-pixel.

4. The display method according to claim 1, wherein step S3 comprises:

obtaining the display component of each sub-pixel by multiplying the original components of the corresponding colors of the virtual pixels corresponding to the sub-pixel by respective proportional coefficients and then summarizing the respective products.

5. The display method according to claim 2, wherein step S3 comprises:

obtaining the display component of each sub-pixel by multiplying the original components of the corresponding colors of the virtual pixels corresponding to the sub-pixel by respective proportional coefficients and then summarizing the respective products.

6. The display method according to claim 3, wherein step S3 comprises:

obtaining the display component of each sub-pixel by multiplying the original components of the corresponding colors of the virtual pixels corresponding to the sub-pixel by respective proportional coefficients and then summarizing the respective products.

7. The display method according to claim 4, wherein the sum of the proportional coefficients for the original components of the corresponding colors of the respective virtual pixels corresponding to each sub-pixel is 1.

8. The display method according to claim 4, wherein the proportional coefficients for the original components of the corresponding colors of the virtual pixels corresponding to the sub-pixel range from 0 to 0.3.

9. The display method according to claim 8, wherein the proportional coefficients range from 0.1 to 0.2.

10. The display method according to claim 1, wherein the step S3 comprises: the display component of a sub-pixel is equal to a median value of the original components of the corresponding colors of the respective virtual pixels corresponding to the sub-pixel.

11. The display method according to claim 2, wherein the step S3 comprises: the display component of a sub-pixel is equal to a median value of the original components of the corresponding colors of the respective virtual pixels corresponding to the sub-pixel.

12. The display method according to claim 3, wherein the step S3 comprises: the display component of a sub-pixel is equal to a median value of the original components of the corresponding colors of the respective virtual pixels corresponding to the sub-pixel.

13. The display method according to claim 1, wherein both the original components and the display component are luminance and the method further comprises a step S4 after step S3:

S4, calculating a gray scale of each sub-pixel in accordance with the display component of the sub-pixel.

14. The display method according to claim 2, wherein both the original components and the display component are luminance and the method further comprises a step S4 after step S3:

S4, calculating a gray scale of each sub-pixel in accordance with the display component of the sub-pixel.

15. A display panel, comprising a plurality of rows of sub-pixels, the sub-pixels in each row are arranged in cyclical orders of sub-pixels of three colors, and the cyclical orders of the sub-pixels in the respective rows being the same, the adjacent sub-pixels in a column direction having different colors and being staggered from each other by ½ of a sub-pixel in a row direction;

wherein a dimension of a sub-pixel in each of the first row and the last row in the column direction is ½ of that of a standard sub-pixel in the column direction, said standard sub-pixel being sub-pixels which are not located on a top edge or a bottom edge of the display panel, each standard subpixel has a same area, and an area of the subpixel in each of the first row and the last row of the display panel is ½ of the area of the standard subpixel.

16. The display panel according to claim 15, wherein the sub-pixels of three colors are a red sub-pixel, a blue sub-pixel and a green sub-pixel.

* * * * *